US005556013A

United States Patent [19]

Mayer

[11] Patent Number: 5,556,013

[45] Date of Patent: Sep. 17, 1996

[54] INTIMATE GARMENT PROTECTOR

[75] Inventor: Bruno Franz P. Mayer, Santa Ana, Calif.

[73] Assignee: Ingenious Design Products, Los Angeles, Calif.

[21] Appl. No.: 252,671

[22] Filed: Jun. 2, 1994

[51] Int. Cl.[6] ..... D06C 15/00; D06F 35/00

[52] U.S. Cl. ..... 223/84; 223/66; 223/1

[58] Field of Search ..... 223/84, 57, 66, 223/1; 450/41–55; 206/278, 292; 248/275; 269/237, 287, 901, 254 CS; 99/323

[56] References Cited

U.S. PATENT DOCUMENTS

| | | | |
|---|---|---|---|
| 453,972 | 6/1891 | Gray | 99/323 |
| 916,327 | 3/1909 | Kingsbury | 99/323 |
| 981,805 | 1/1911 | Smith | 99/323 |
| 2,190,807 | 2/1940 | Steinberger | 223/57 |
| 2,490,308 | 12/1949 | Delgutto | 223/84 |
| 3,224,654 | 12/1965 | Giuseffi | 223/57 |
| 3,837,476 | 9/1974 | Schwartz | 206/278 |
| 4,063,637 | 12/1977 | Danforth | 223/84 |
| 5,074,410 | 12/1991 | Fries et al. | 223/84 |
| 5,090,559 | 2/1992 | Gendreau | 206/284 |
| 5,172,837 | 12/1992 | Finney, Jr. et al. | 223/23 |

FOREIGN PATENT DOCUMENTS

| | | | |
|---|---|---|---|
| 931003 | 6/1955 | Germany | 223/84 |

*Primary Examiner*—C. D. Crowder
*Assistant Examiner*—Bibhu Moharty
*Attorney, Agent, or Firm*—Steven G. Roeder; Sheldon & Mak, Inc.

[57] ABSTRACT

An intimate garment protector for protecting a garment or multiple garments, namely bras, during laundering. The device comprises first and second basket members that are designed and configured to receive the cup portions of at least one bra. Preferably, the basket members have a generally dome-like or conical-like shape. The device further includes first and second biasing members wherein the first biasing member is designed and configured to be received within the first basket member and the second biasing member is shaped and configured to be received within the second basket member. Accordingly, by placing the cup portions of the bra or bras in the basket members and then placing the biasing members thereupon, a sandwich-like configuration is formed that protects the shape and contours of the bra during the washing process. Preferably, the intimate garment protector further includes for hinge-like attachments between the first biasing member and first basket member, the second biasing member and second basket member and the first basket member and second basket member. Furthermore, the garment protector is preferably designed such that the basket members, while containing a bra or multiple bras disposed therein, may form a ball or football-like configuration and include means for detachably forming such configuration.

23 Claims, 2 Drawing Sheets

INTIMATE GARMENT PROTECTOR

FIELD OF THE INVENTION

The present invention relates to devices for protecting garments, and more particularly, to devices for protecting intimate garments, namely bras, during conventional machine laundering cycles.

BACKGROUND OF THE INVENTION

The washing and drying of garments is a routine chore undertaken by millions of people throughout the world. Among such garments include items of apparel that come into intimate contact with the human body, i.e., underwear. Because of the close and intimate contact between the body and such garments, such garments must be thoroughly cleaned.

Such intimate garments, however, are often made of delicate fabrics and are specially designed to adapt to the contours of the body. Most notable of such garments is the bra whereby the bra, and more particularly the cup portions and strap portions of the bra, are often formed of fragile fabric having pre-formed, cup members, pads, and wire supports that help enhance the fit of the garment when worn by the user. Such structures, however, lend themselves to tearing deformation and damage when subjected to laundering processes in conventional washing machines and dryers.

As such, these garments can become severely damaged, if not ruined, if subjected to multiple laundering processes. To avoid such damaging action, many users hand-wash such garments which unfortunately takes considerable time, labor, and is inconvenient.

Accordingly, there is a need in the art to provide an intimate garment protector that protects the shape of the garment while allowing the garment to be laundered by conventional washing machines and dryers. Additionally, there is a need for an intimate garment protector that is simple to use and is made of durable inexpensive materials that allow the protector to be repeatedly used.

SUMMARY OF THE INVENTION

The present invention specifically addresses and alleviates the above-mentioned deficiencies associated in the art. More particularly, the present invention is directed to an intimate garment protector specifically adapted to protect the shape and contours of a garment or multiple garments, namely bras, during washing and drying in conventional washing machines and dryers. The protector includes first and second basket members that are shaped and configured to receive the cup portions of a bra. Preferably, the basket members are dome-shaped or conical-shaped, although other shapes well suited for receiving such cup portions may be utilized. Additionally, the basket members are preferably sized to allow multiple cup portions to be stacked therein and thus allow multiple garments to be laundered simultaneously. Each basket member further includes a biasing member insertible therein, such that when a cup portion of a bra is placed within a basket member, the biasing member may be placed within the inner cup portion of the bra to press the cup portion tightly against the basket member and thereby maintain the proper configuration of the cup member throughout the laundry cycle. Preferably, each biasing member is hingingly attached to a respective basket member into which the biasing member is inserted. Additionally, the protector preferably provides that the basket members are hingingly attached to one another such that when the cup portions of the bra are placed within the basket members and the biasing members are positioned within the cup portions of the bra, the two basket members may be rotated inwardly toward each other to form either a ball-type configuration, should the basket members have a generally dome-like shape, or a football-type configuration should the basket members have a generally conical-like shape. Furthermore, a fastening member formed on at least one of the basket members is preferably provided so that the protector can detachably form such ball-type or football-type configurations. Advantageously, while the protector is maintained in either of these ball-type or football-type configurations, the garment or garments contained therein may be washed and dried via a conventional washing machine and dryer and thus be thoroughly cleaned while not being subjected to any forces that could deform or otherwise damage the same.

It is therefore an object of the present invention to provide an intimate garment protector that will protect the shape and contours of a garment while the garment is washed and dried in conventional washing machines and dryers.

Another object of the present invention is to provide an intimate garment protector that protects a garment during the washing and drying processes while allowing the garment to be thoroughly and completely cleaned.

Another object of the present invention is to provide an intimate garment protector that allows multiple garments to be simultaneously laundered.

Another object of the present invention is to provide an intimate garment protector made of inexpensive durable materials such that the protector may be repeatedly used.

Yet another object of the present invention is to provide an intimate garment protector that is easy to use.

DETAILED DESCRIPTION OF THE PREFERRED EMBODIMENT

Figure 1:
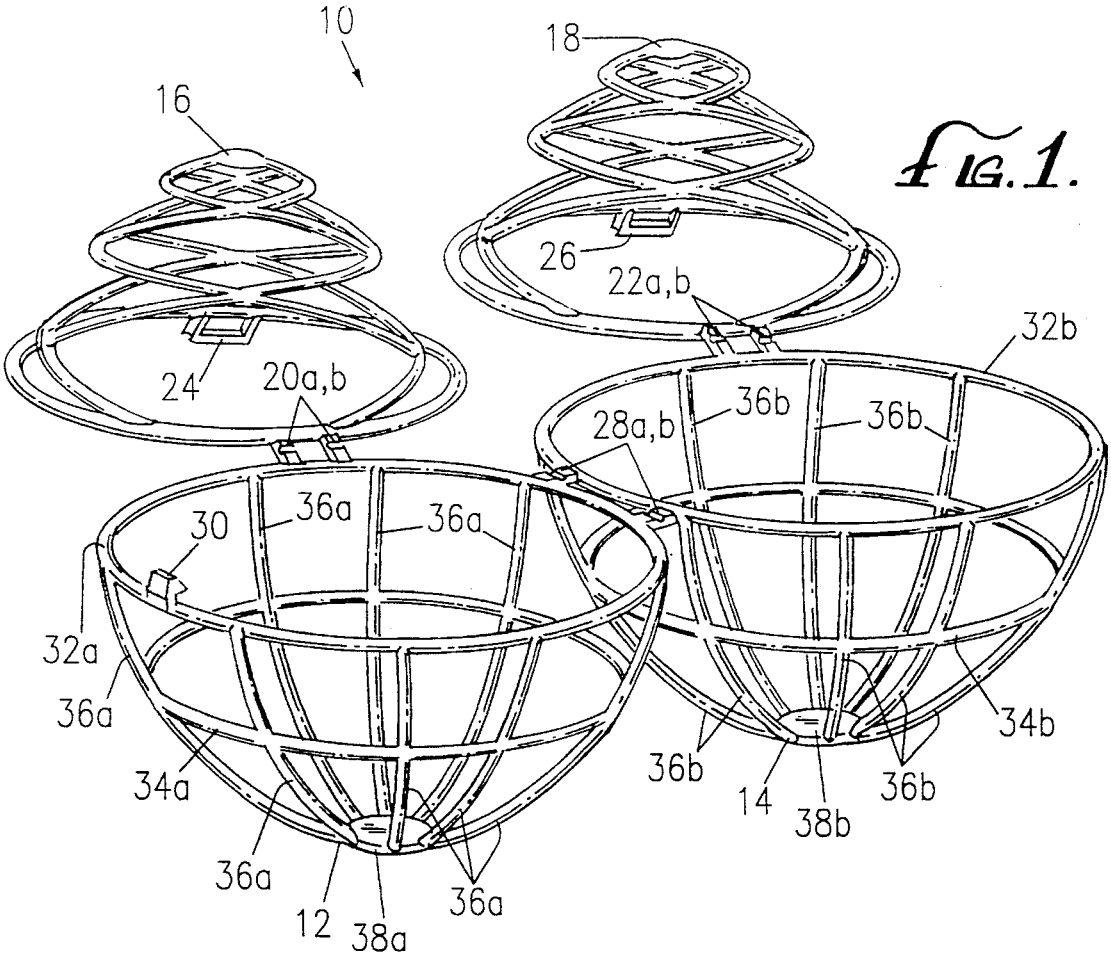
FIG. 1 is a perspective view of an intimate garment protector according to a preferred embodiment of the present invention.

Referring to the drawings, and more particularly to FIG. 1, there is shown an intimate garment protector 10 embodying the principles of the present invention. The device 10 comprises a first basket member 12 and a second basket member 14. Preferably, the first basket member 12 and second basket member 14 are hingingly attached to one another by basket member hinge 28*a,b*.

Figure 2:
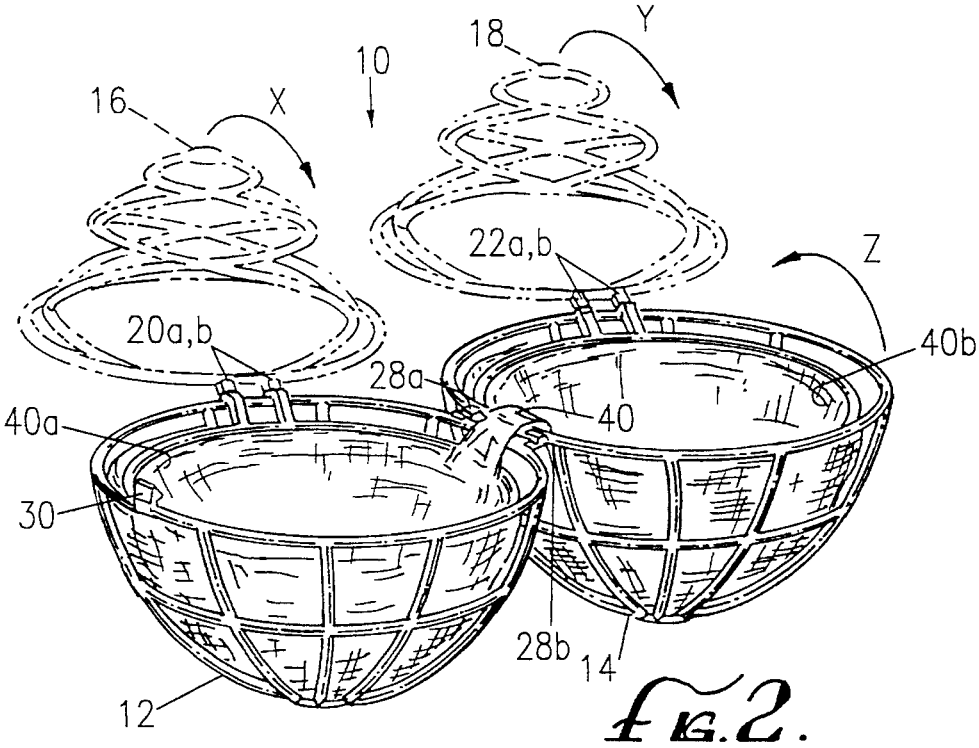
FIG. 2 is a perspective view of the intimate garment protector having a bra placed therein.

The basket members 12, 14 are designed and configured to receive and provide structural support for the cup portions of a bra, more clearly depicted as 40*a* and 40*b* in FIG. 2, when a bra is placed therein. Preferably, the basket members 12, 14 are generally dome-shaped, as shown, or, in a most preferred embodiment, are generally conical-shaped. However, as those skilled in the art will recognize, other shapes suited to receive such cup portions may also be utilized. Additionally, each basket member 12, 14 is preferably sized to accommodate padded cups as well as a plurality of cups that may be stacked therein. As such, the garment protector 10 of the present invention may be used to wash such thicker cup-sized bras and allow multiple bras to be washed and dried simultaneously. Furthermore, each basket member 12, 14 is preferably configured to have an open-cell configuration formed by annular support members or ribs 32*a*, 34*a*, 32*b*, 34*b*, and arcuate support members or ribs 36*a*, 36*b*. Advantageously, this open-cell or wall configuration enables water, air, and detergent to easily penetrate throughout the fabric of the garment or garments so that such garment or garments become thoroughly cleaned and dried during the machine laundry process.

The protector 10 also includes first biasing member 16 and second biasing member 18. The biasing members 16, 18 comprise generally spring-like members and are shaped and configured to be positioned within the cup portions of a bra 40*a*, 40*b* when the cup portions of the bra 40*a*, 40*b* are placed within the basket members 12, 14, as depicted in FIG. 2. More specifically, first biasing members 16 is positionable within first basket member 12 and second biasing member 18 is positionable within second basket member 14. Furthermore, each biasing member 16, 18 is designed and adapted to be positioned within cups of most conventional sizes and thicknesses as well as multiple cups from multiple bras stacked on top of one another. Preferably, each biasing member 16, 18 is hingingly attached onto a respective basket member 12, 14 into which the biasing member 16, 18 is to be placed. Accordingly, first biasing member hinge 20*a,b* provides the hinge-type attachment whereby the first biasing member 16 may be rotatably inserted within the first basket member 12. Likewise, second biasing member hinge 22*a,b* provides such hinge-type attachment between second biasing member 18 and second basket member 14.

In the preferred embodiment, the protector 10 is formed of a polymer material, preferably injected molded as a unitary member such that the hinge members may comprise living hinges. As will be recognized, in the preferred embodiment, the basket members 12 and 14 are preferably formed to be substantially rigid while the biasing members 16 and 18 are formed to be more pliable in structure. As such, during insertion of the biasing members into the basket members, the biasing members deform and compress to conform to the shape and configuration of the basket members 12, 14.

To insure that the first biasing member 16 remains positioned within the first basket member 12 and second biasing member 18 likewise remains within second basket member 14, locking members 24, 26 are provided to allow for detachable engagement between the biasing members 16, 18 and basket members 12, 14. More specifically, first locking member 24 is formed upon the first biasing member 16 such that when the first biasing member is placed within the first basket member 12, first locking member 24 engages one of the annular support members, namely first annular support member 32*a*, such that the biasing member 16 remains in place. Such detachable fastening arrangement can be seen in FIG. 4. Similarly, second locking member 26 is formed upon second biasing member 18 such that when the second biasing member 18 is placed inside the second basket member 14, second locking member 26 attaches to annular support member 32*b*.

Figure 7A:
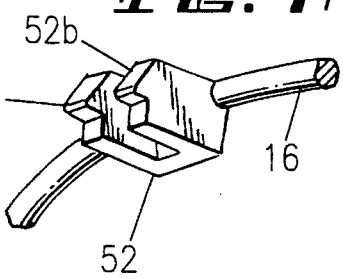
FIG. 7*a* is a perspective view of a more highly preferred locking member formed on a biasing member for detachably engaging with a basket member.
Figure 7B:
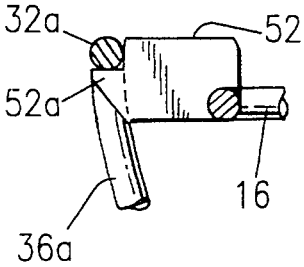
FIG. 7*b* is a cross-sectional view of the preferred locking member in FIG. 7*a* in detachable engagement with a basket member of the intimate garment protector.

Referring now to FIGS. 7*a* and 7*b*, there is shown a preferred locking member 52 and preferred interconnected arrangement between the biasing member 16 and a rim 32*a* and rib 36*a* of the first basket member 12. FIG. 7*a* depicts the preferred locking member 52 which, similar to locking member 24, is formed upon the first biasing member 16. Additionally, as shown in FIG. 7*a*, the preferred locking member 52 has two outwardly extending detents 52*a*, 52*b* that provide means for detachably engaging with both rim 32*a* and a respective one of the plurality of ribs 36*a*. Advantageously, by providing for such engagement with rim 32*a* and rib 36*a*, the preferred locking member 52 thus provides lateral support to the interconnected biasing member 16 and basket member 12 when the two are interconnected as shown in FIG. 7*b*. As will be recognized, such preferred locking member 52 may also be formed on second biasing member 18 such that second biasing member 18 may form similar engagements with second basket member 14.

Referring now to FIG. 2, there is shown the sequence and arrangement by which the protector 10 is utilized to provide protection to the garment. Initially, the garment 40 is placed within the protector 10 such that the cup portions 40*a*, 40*b* of the bra are received within basket members 12, 14. As shown, cup portion 40*a* is received within the first basket member 12 and cup portion 40*b* is received within second basket member 14. Once placed therein, the straps of the bra may additionally be dispensed within the basket members 12, 14 and biasing members 16, 18 are rotated inwardly into the respective basket members 12, 14. As shown, first biasing member 16 rotates inwardly about first biasing member hinge 20*a,b* in the direction indicated by the letter "X". Similarly, second biasing member 18 rotates inwardly about second biasing member hinge 22*a,b* into the second basket member 14 as indicated by the letter "Y". During this rotational movement, the biasing members axially compress against their own internal resiliency causing the cup portions of the bra 40*a* and 40*b* to be continuously urged outwardly and maintained against the basket members 12, 14.

Figure 4:
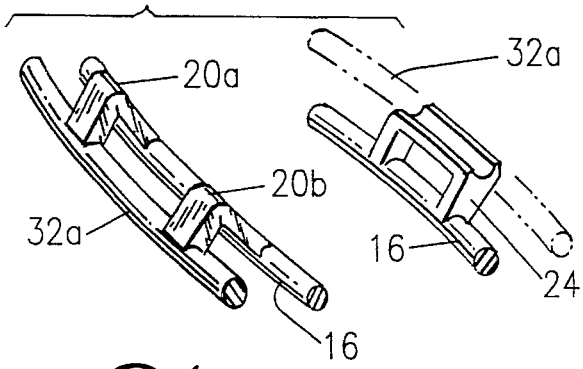
FIG. 4 is a perspective view of a hinge between a basket member and a biasing member as well as a detachable, interconnected arrangement between a biasing member and a basket member while such biasing member and basket member are maintained in the ball-type configuration.

Subsequently, the first locking member 24 formed on the first biasing member 16 is engaged with first annular support member 32*a* of the first basket member 12. Likewise, second locking member 26 is engaged with annular support member 32*b* of the second basket member 14. FIG. 4 illustrates the position and arrangement that first biasing member hinge 20*a,b* and first locking member 24 assume while the protector 10 is maintained in this ball configuration. In particular, first biasing member hinge 20*a,b* is bent such that the first biasing member 16 is downwardly positioned within the first basket member 12. In order to maintain this position within the first basket member 12, first locking member 24 is provided to detachably engage with annular support member 32*a* such that the biasing member 16 is downwardly forced. A similar configuration is formed by second biasing member hinge 22*a,b* and second locking member 26. In this respect, annular support members 32*a,* 32*b* function as rims as these annular support members 32*a,b* provide surfaces upon which the biasing members 16, 18 maintain hinge-like attachment as well as provide means for maintaining the biasing members 16, 18 within the respective basket members 12, 14 via locking members 24, 26.

In an alternative, more preferred embodiment, each biasing member 16, 18 will have preferred locking member 52, shown in FIGS. 7*a,b,* formed thereon instead of first and second locking members 24, 26. As will be recognized, the preferred locking members 52 will be formed on the biasing members 16, 18 such that the preferred locking members 52 are aligned with ribs 36*a,* 36*b* so that such detachable engagement, depicted in FIG. 7*b,* may be formed. Accordingly, such preferred locking members 52, by virtue of their engagement with both annular support members 32*a,* 32*b,* and a respective one of the plurality of ribs 36*a,* 36*b,* will attain greater lateral support.

Once in this configuration, the biasing members 16, 18 will provide a continuous spring-like, outward biasing force which sandwiches the cup portions of the bra 40*a,* 40*b* within the basket members 12, 14. Such compression within the basket members 12, 14 advantageously maintains the cup portions of the bra 40*a,* 40*b* in their desired configuration throughout the laundering process. Furthermore, it should be noted that the network of annular support ribs 32*a,* 34*a,* 32*b,* 34*b* and arcuate support ribs 36*a,* 36*b* that provide the necessary support to maintain the shape of the garment are arranged to allow water and detergent to penetrate within and about the fabric of bra 40 such that the bra 40 becomes thoroughly cleaned when washed in a conventional washing machine.

Figure 3:
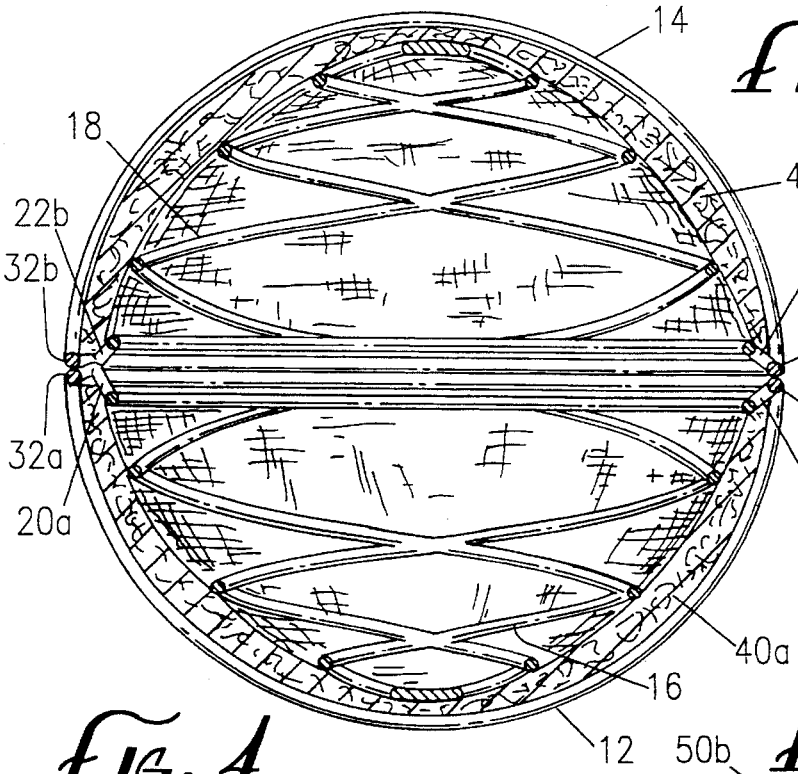
FIG. 3 is a cross-sectional view of the intimate garment protector wherein the protector has a bra contained therein and is maintained in a ball-type configuration.
Figure 5:
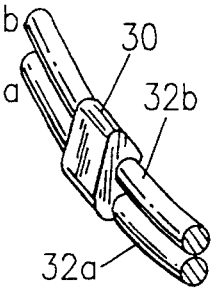
FIG. 5 is a perspective view of a preferred detachable fastening arrangement between the basket members of the intimate garment protector.

Once the biasing members 16, 18 are positioned and latched within the basket members 12, 14, the basket members 12, 14 may be rotated toward one another about basket member hinge 28*a,b* in the direction indicated by the letter "Z" to form a generally ball-shaped configuration as depicted in FIG. 3. As those skilled in the art will recognize, a generally football-shaped configuration will be formed when the basket members 12, 14 are generally conical-shaped. To maintain such ball or football-shaped configuration, fastening member 30, which is formed upon first annular support member 32*a,* is provided to engage with annular support member 32*b,* thereby maintaining the members 12 and 14 together as shown in FIG. 5.

Figure 6A:
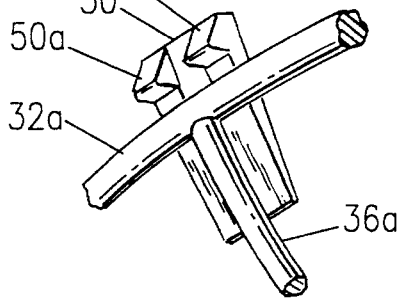
FIG. 6*a* is a perspective view of a more highly preferred fastening member for detachably fastening the basket members to one another.
Figure 6B:
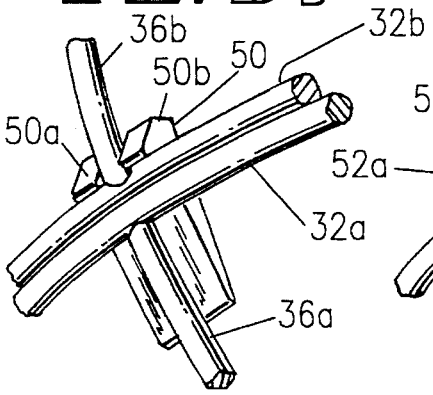
FIG. 6*b* is a perspective view of a more highly preferred detachable fastening arrangement between the basket members of the intimate garment protector utilizing the preferred fastening member in FIG. 6*a;*

In a more highly preferred embodiment, there is shown in FIGS. 6*a* and 6*b* a preferred fastening member 50 utilized to detachably interconnect the basket members 12, 14 of the protector 10. The preferred fastening member 50 extends upwardly from annular support rib 32*a* and is preferably aligned with a respective one of the plurality of arcuate support ribs 36*a*. The preferred fastening member 50 further includes two outwardly extending detents 50*a,* 50*b* that are configured and designed to provide secure attachment with annular support rib 32*b* as well as a respective one of the plurality of arcuate support ribs 36*b* shown more clearly in FIG. 6*b*. As those skilled in the art will appreciate, the preferred fastening member 50, with outwardly extending detents 50*a,* 50*b,* will not only provide secure attachment between annular support ribs 32*a,* 32*b,* but will also provide significant lateral support by engaging with the arcuate support rib 36*b*. Such enhanced interconnection advantageously provides means for more securely maintaining the protector 10 in such ball or football-shaped type configurations that will prevent the protector 10 from slipping out of engagement from such configurations during the washing process.

FIG. 3 more clearly depicts the ball configuration, formed by the detachable engagement between basket members 12, 14, wherein the cup portions of the bra 40*a,* 40*b* are sandwiched between the respective basket members 12, 14 and biasing members 16, 18. The cross-sectional view shows how the biasing members 16, 18 force the bra to maintain its cup-like shape against basket members 12, 14 such that the cup shape is unable to deform or warp out of shape. Additionally, this ball configuration or, alternatively, the football-shaped configuration, is quite advantageous in that such configurations allow for easy handling and allow the garment or multiple garments to be washed in a space-efficient manner.

While in this ball or football-shaped configuration, the garment and protector may subsequently be placed in a conventional washing machine and allowed to be washed therein. During washing, the basket members prevent the bra from deformation as well as prevent the straps of the bra from becoming tangled with other articles within the clothes washer. Additionally, should the user desire, the garment and protector 10 may further be placed in a conventional dryer for drying purposes. Upon completion of the washing and drying process, the user may then disassemble the protector 10 by first disengaging the interconnected annular support members 32*a,* 32*b* by releasing annular support member 32*b* from fastening member 30 or, in the more highly preferred embodiment, from preferred fastening member 50. Having thus opened up the protector 10, the user may then release the biasing members 16, 18 from basket members 12, 14 by releasing first and second locking members 24, 26 or, in the more highly preferred embodiment, preferred locking members 52 from the annular and arcuate support members 32*a,* 32*b,* 36*a,* 36*b* of the basket members. Accordingly, the garment or garments may then be removed and the protector 10 may then be stored or reused as desired.

There has thus been disclosed an intimate garment protector, with various preferred embodiments thereof, having been described in detail with the various advantages being set forth. It is understood, however, that equivalents are possible and that variations in structure may be made that fall Within the underlying principles of the present invention.

What is claimed is:

1. A garment protector for protecting cup portions of at least one garment, the garment protector comprising:

(a) first and second basket members, the basket members being shaped and configured to receive the cup portions of at least one garment;

(b) first and second biasing members, the first biasing member being shaped and configured to be received within and detachably interconnected with the first basket member, the second biasing member being shaped and configured to be received within and detachably interconnected with the second basket member; and (c) wherein when the cup portions of at least one garment are received within the first and second basket members, the first biasing member is positionable within the first member and the second biasing member is positionable within the second member such that the cup portions of at least one garment are protectably compressed within the basket members;

wherein, the basket members are hingingly attached together.

2. A garment protector for protecting cup portions of at least one garment, the garment protector comprising:

(a) first and second basket members, the basket members being shaped and configured to receive the cup portions of at least one garment;

(b) first and second biasing members, the first biasing member being shaped and configured to be received within and detachably interconnected with the first basket member, the second biasing member being shaped and configured to be received within and detachably interconnected with the second basket member;

(c) wherein when the cup portions of at least one garment are received within the first and second basket members, the first biasing member is positionable within the first member and the second biasing member is positionable within the second member such that the cup portions of at least one garment are protectably compressed within the basket members;

(d) wherein, the first biasing member is hingingly attached to the first basket member such that the first biasing member is rotatably insertible within the first basket member; and (e) wherein, the second biasing member is hingingly attached to the second basket member such that the second biasing member is rotatably insertible within the second basket member.

3. The garment protector of claim 1 wherein the first and second basket members have a generally dome-like shape.

4. The garment protector of claim 1 wherein the first and second basket members have a generally conical-like shape.

5. The garment protector of claim 3 wherein when the cup portions of at least one garment are received within the first and second basket members and the first biasing member is detachably interconnected with the first basket member and the second biasing member is detachably interconnected with the second basket member, the first basket member and the second basket member are inwardly rotatable toward one another such that a ball-shaped configuration is formed.

6. The garment protector of claim 4 wherein when the cup portions of at least one garment are received within the first and second basket members and the first biasing member is detachably interconnected with the first basket member and the second biasing member is detachably interconnected with the second basket member, the first basket member and the second basket member are inwardly rotatable toward one another such that a football-shaped configuration is formed.

7. The garment protector of claim 5 wherein further comprising fastening means for detachably maintaining the first and second cup-shaped basket members in the ball-shaped configuration.

8. The garment protector of claim 6 wherein further comprising fastening means for detachably maintaining the first and second basket members in the football-shaped configuration.

9. A garment protector for protecting cup portions of at least one garment, the garment protector comprising:

(a) first and second basket members, the basket members being shaped and configured to receive the cup portions of at least one garment;

(b) first and second biasing members, the first biasing member being shaped and configured to be received within and detachably interconnected with the first basket member, the second biasing member being shaped and configured to be received within and detachably interconnected with the second basket member; and (c) wherein when the cup portions of at least one garment are received within the first and second basket members, the first biasing member is positionable within the first member and the second biasing member is positionable within the second member such that the cup portions of at least one garment are protectably compressed within the basket members; wherein at least one of the basket members has an open-cell wall arrangement comprised of a network of annular support members and arcuate support members.

10. The garment protector of claim 9 wherein the annular support members and the arcuate support members are spaced to simultaneously provide structural support to aid cup portions of at least one garment and allow water and detergent to penetrate into the at least one garment when the at least one garment is positioned within the garment protector and washed in a conventional washing machine.

11. A garment protector for protecting cop portions of at least one garment, the garment protector comprising:

(a) first and second basket members, the basket members being shaped and configured to receive the cup portions of at least one garment;

(b) first and second biasing members, the first biasing member being shaped and configured to be received within and detachably interconnected with the first basket member, the second biasing member being shaped and configured to be received within and detachably interconnected with the second basket member; and (c) wherein when the cup portions of at least one garment are received within the first and second basket members, the first biasing member is positionable within the first member and the second biasing member is positionable within the second member such that the cup portions of at least one garment are protectably compressed within the basket members; wherein at least one of the biasing members includes an open-cell configuration which allows water and detergent therethrough.

12. The garment protector of claim 1 wherein the garment protector is fabricated from resilient polymer material capable of withstanding forces produced by conventional washing machines and dryers when placed therein.

13. The garment protector of claim 12 wherein the protector is integrally formed by an injection molding process.

14. A garment protector for protecting cup portions of at least one garment during washing, the garment protector comprising:

(a) a first generally dome-shaped basket member having a rim formed thereabout, the first basket member having a first biasing member hingingly engaged to a portion of the rim, the first biasing member being shaped and configured to rotate inwardly and be received within the first basket member, the first biasing member having a first locking member formed thereon for engaging with the rim such that the first biasing member is detachably fixed into position within the first basket member;

(b) a second generally dome-shaped basket member having a rim formed thereabout, the second basket member having a second biasing member hingingly engaged to a portion of the rim, the second biasing member being shaped and configured to rotate inwardly and be received within the second biasing member, the second biasing member having a second locking member formed thereon for engaging with the rim such that the second biasing member is detachably fixed into position within the second basket member; and (c) wherein the first basket member is hingingly engaged with the second basket member such that when the cup portions of at least one garment are placed within the basket members and when each respective biasing member is received within each respective and corresponding basket member, the basket members may be inwardly rotated toward one another such that a ball-type configuration is formed.

15. The garment protector of claim 14 wherein the hinge between the basket members connects the rim of the first basket member with the rim of the second basket member.

16. The garment protector of claim 15 wherein the hinge between the basket members is approximately 90 degrees from a respective hinge attachment between a respective biasing member and basket member to which the respective biasing member is to be received.

17. The garment protector of claim 14 wherein the first and second basket members have a generally conical-like shape, the basket members being inwardly rotatable toward one another such that a football-type configuration is formed.

18. The garment protector of claim 14 wherein the garment is a bra.

19. A garment protector comprising:

(a) first and second dome-shaped basket members hingingly connected to one another and inwardly rotatable toward one another such that a ball-shaped configuration is formed, at least one of the basket members including an open-cell wall arrangement having a network of annular support members and arcuate support members which are spaced apart to provide structural support to the basket member and allow water and detergent to penetrate into the garment protector when the garment protector is washed;

(b) a fastener for detachably maintaining the first and second basket members in the ball-shaped configuration: and (c) at least a first biasing member within the first basket member for holding a portion of the garment against the first basket member.

20. The garment protector of claim 19 wherein the first biasing member is shaped and configured to be received within and detachably interconnected with the first basket member.

21. The garment protector of claim 20 wherein each biasing member includes an open-cell configuration which allows water and detergent therethrough.

22. The garment protector of claim 20 wherein, the first biasing member is hingingly attached to the first basket member so that the first biasing member is rotatably insertible within the first basket member.

23. The garment protector of claim 20 wherein the first and second basket members have a conical-like shape and the basket members are inwardly rotatable toward one another such that a football-type configuration is formed.

* * * * *